United States Patent [19]

Wulf et al.

[11] Patent Number: 4,638,632

[45] Date of Patent: Jan. 27, 1987

[54] EXHAUST GAS PIPE COOLED BY AMBIENT AIR

[75] Inventors: Rudolf Wulf, Göttingen; Wolfgang Stäger, Hann-Münden, both of Fed. Rep. of Germany

[73] Assignee: Deutsche Forschungs-und Versuchsanstalt für Luft-und Raumfahrt e.V., Cologne, Fed. Rep. of Germany

[21] Appl. No.: 705,419

[22] Filed: Feb. 27, 1985

Related U.S. Application Data

[63] Continuation of Ser. No. 517,160, Jun. 16, 1983, abandoned, which is a continuation of Ser. No. 245,112, Mar. 18, 1981, abandoned.

[30] Foreign Application Priority Data

Mar. 20, 1980 [DE] Fed. Rep. of Germany ..... 3010598

[51] Int. Cl.[4] ..... F01N 3/02

[52] U.S. Cl. ..... 60/319; 60/39.5; 60/264; 60/317; 98/78; 110/160; 239/127.3

[58] Field of Search ..... 60/316, 317, 319, 39.5, 60/264; 98/78; 110/160; 239/127.3

[56] References Cited

U.S. PATENT DOCUMENTS

| | | | |
|---|---|---|---|
| 2,886,946 | 5/1959 | Parker | 239/127.3 |
| 3,244,255 | 4/1966 | Possell | 239/127.3 |
| 3,726,091 | 4/1973 | Tontini | 60/264 |
| 3,817,030 | 6/1974 | Renius | 60/39.5 |
| 3,857,458 | 12/1974 | Ohtani | 60/319 |
| 4,196,585 | 4/1980 | Svischev | 239/127.3 |

FOREIGN PATENT DOCUMENTS

| | | | |
|---|---|---|---|
| 531327 | 10/1921 | France | 98/78 |
| 386901 | 1/1933 | United Kingdom | 60/316 |
| 584254 | 1/1947 | United Kingdom | 60/319 |

*Primary Examiner*—Douglas Hart
*Attorney, Agent, or Firm*—Max Fogiel

[57] ABSTRACT

An exhaust pipe outlet is surrounded by a jacket part having an inlet of larger diameter, permitting air to be drawn into the jacket part to isolate it from contact with the hot exhaust gases. Blocking air may be injected at the downstream end of the jacket part.

7 Claims, 3 Drawing Figures

EXHAUST GAS PIPE COOLED BY AMBIENT AIR

This is a continuation of application Ser. No. 517,160, filed June 16, 1983, and now abandoned, which was a continuation of application Ser. No. 245,112, filed Mar. 18, 1981, and now abandoned.

The invention relates to an exhaust gas pipe cooled by ambient air, especially a ship's exhaust stack, exhaust gas pipe for tanks, helicopters or the like, for the removal of hot exhaust gases from drive engines, especially motors, turbines and the like.

In the operation of drive engines hot exhaust gases necessarily develop which must be discharged to the surroundings via an exhaust gas pipe. These hot exhaust gases also heat up the exhaust gas pipe itself. Since such exhaust gas pipes are as a rule of metal, the free end regions of the exhaust gas pipes which are cooled by the ambient air, also assume a substantial temperature. Additionally, it is unavoidable that soot and carbon particles are carried from the drive engines along with the exhaust gas, which become deposited at corners and edges, and even in the region of the free end of the exhaust gas pipe at the wall, where they undergo afterglowing. In military applications it is known to use infrared detection of such hot spots of exhaust gas pipes, in order to identify the objects in question and to locate them. This infrared detection allows especially ship's exhaust stacks to be readily located because the free ends of the exhaust gas pipes used there have a substantial temperature, on about the order of 400° to 500° C. In case of unfavorable wind directions these temperatures are partially even exceeded, i.e. if the direction of movement of the ship and the wind direction are so unfavorable relative to one another that the exhaust gas flow in the exhaust gas pipe is pressed in the outlet region towards one side and against the wall. This happens in particular if a ship's exhaust stack is exposed to strong cross winds.

In ship's exhaust stacks it is customary to provide an enclosure for the stack. The enclosure surrounds the stack and extends to a certain height relative to the free end of the exhaust gas pipe. This enclosure, however, significantly worsens the cooling of the actual exhaust gas pipe by ambient air. From a certain overhead angle such a ship can therefore still be detected from a flying body. In tanks and helicopters the exhaust gas pipes are located in the ambient air without coverings, so that here a cooling effect is obtained. On the other hand, however, there is the danger that the exhaust gas pipe itself will become hot and will be freely accessible for detection over a greater length.

Ejectors are used in many technical applications, as e.g. water-jet pumps, steam-jet pumps and the like. Ejectors employ the impulse of the exiting liquids or gases to aspirate liquid or gases from the ambient surroundings and to entrain them. Known ejectors use primary jets with high outflow speeds. Surface ratios on the order of five or more are employed. The surface ratio is understood to be the ratio of the exit area of primary and secondary flow to the exit area of the primary flow.

The purpose of the invention is to significantly reduce the temperature of the exhaust gas pipes of the type described in the beginning, in the end region thereof, so that infrared detection no longer works or is at least made much more difficult. If possible, no additional energy should have to be expended for the reduction of the temperature.

According to the invention this is achieved in that the exhaust gas pipe is surrounded, in the region of its free end and beyond the same in outflow direction, by a jacket part which forms with the end of the exhaust gas pipe an ejector for the admixing of cool ambient air, and that the jacket part has at all locations a larger diameter than the exhaust gas pipe. Thus, an ejector is used for the first time in this area of technology, but serving in this instance to provide a solution for the specific problem. No additional drive energy is needed for admixing of the ambient air. The cool ambient air in effect jackets the hot exhaust gases, and of course after the end of the exhaust gas pipe there is an annular mixing zone between the hot exhaust gases and the cool ambient air. The jacket part of the ejector can readily be so constructed and dimensioned that even this mixing zone does not reach the boundary layer at the inner wall of the jacket part. Accordingly, the jacket part remains cool. The aspirated ambient air cools the free end of the jacket part to a temperature below 100° C. No additional drive is needed for this; in fact, due to the diffusor effect of the ejector energy is even saved. The reason for this is that a pressure recovery takes place. With the aid of the ejector a reduction of the counter pressure for the drive machine is obtained. Especially the effectiveness of gas turbines depends strongly on this counter pressure, which is composed of the pressure loss in the exhaust gas pipes and the exhaust gas discharge. Thus, the use of an ejector simultaneously increases the degree of effectiveness of the turbine. The use of the injector also obviates the possible use of additional blowers. This also saves weight as well as drive energy. The jacket part of the ejector is so configurated that the inflow of the cool ambient air (second air) is as loss-free as possible.

The ejector inlet formed between the end region of the exhaust gas pipe and the jacket part may have a cross-section which increases counter to the inflow direction of the ambient air to be admixed. In principle, however, a cylindrical cross-section is also possible. However, the enlargement is found advantageous in terms of flow conditions. It must also be taken into account that the mixing zone between the core flow of the primary flow and the secondary flow diverges conically. Accordingly, the jacket part is to be so divergently constructed that a contact of the hot exhaust gases of the core flow against the jacket part is avoided.

The area ratio of the jacket part to the exhaust gas pipe should be at least 1.5. Despite this small area ratio a large quantity of secondary air is aspirated and thus an effective cooling of the jacket part is obtained.

The jacket part may be followed by another jacket part and the two jacket parts together may form a second ejector. This system is expandable. With this measure the temperature in the marginal ranges is on the one hand further decreased, and on the other hand the viewing angle from above is reduced.

In addition, one jacket part may be provided with an annular conduit for the supply of blocking air which is fed under pressure, and which is blown out at the inner wall of the jacket part via an annular nozzle. This blowing-out of blocking air serves to reduce the wall temperature at the endangered free portion of the jacket part. A blower is needed to supply the blocking air, but the quantities to be supplied are relatively small. The annular nozzle may also be subdivided in individual regions, which depending upon the wind direction are individually used for blowing out the blocking air, in order to carry out this measure most effectively.

The invention is usable not only for military applications. The arrangement of an ejector may reduce the danger of sooting in the case of free-standing building chimney. In the event of cross-blowing against a free-standing or building chimney, the ejector prevents the $SO_2$ or $CO_2$ containing exhaust gases from creeping along the outer part of the chimney wall at the lee side of the chimney. Since a condensation takes place at the jacket part of the ejector, care must be taken that the condensate can be removed from there in some manner. In addition, this measure improves the chimney draft.

Exemplary embodiments of the invention are shown in the drawings and are hereafter described in more detail.

Figure 1:
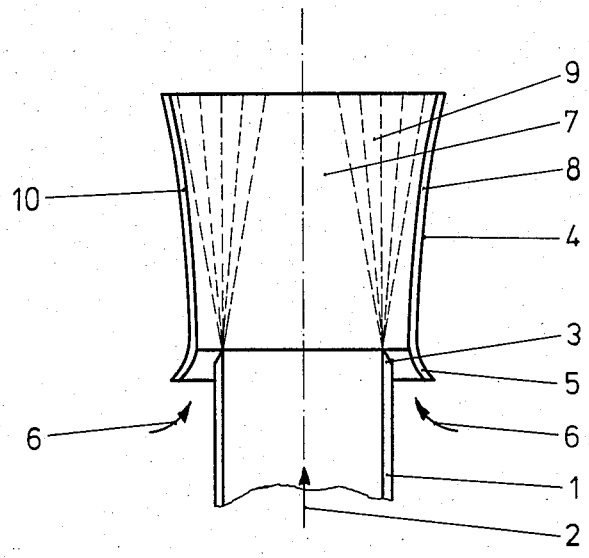
FIG. 1 shows a first embodiment of the exhaust gas pipe with ejector.

The hot exhaust gases are yielded up to the environment according to arrow 2, through the exhaust gas pipe 1 of which only the end region is shown. The free end 3 is surrounded by a jacket part 4 which here is configurated as a non-uniformly expanding double cone. The jacket part 4 has an inlet 5 which surrounds the free end 3 of the exhaust gas pipe 1, so that in this manner an ejector is formed which aspirates and entrains the ambient air between the outer diameter of the exhaust gas pipe 1 and the inlet 5, according to arrows 6. The core stream 7 retains the temperature of the exhaust gases according to arrow 2. The ambient air according to arrow 6 forms at the inner wall 8 of the jacket part 4 a boundary layer. Between these two there extends a ring which is called the mixing zone 9 and in which a mixed temperature develops from the hot exhaust gases and the ambient air. In the mixing zone 9 the cooling ambient air and the hot exhaust gases intermix over a varied temperature range denoted by the dashed lines within the zone in FIG. 1. The temperature will vary from a higher temperature near the core stream 7 to a lower temperature in vicinity of the jacket part 4 due to the cooling ambient air flowing through inlet 5 and along the inner wall of the jacket part 4. As is evident, the shape of the jacket part 4 is so selected that neither the core stream 7 nor the mixing zone 9 can contact the inner wall 8 of the jacket part 4. In this manner it is assured that the jacket part 4, especially at its most endangered free end 10, assumes a temperature which under all circumstances is below 100°. Infrared detection under a certain viewing angle is thus no longer possible, if the free end 3 of the exhaust gas pipe 3 is not visible.

Figure 2:
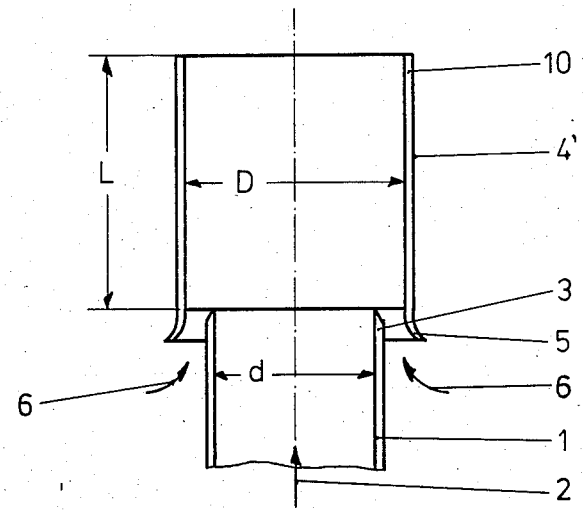
FIG. 2 shows a second embodiment of the exhaust gas pipe with ejector.

The embodiment of FIG. 2 has a cylindrical jacket part 4'. The geometric relationships of the inner diameter D of the jacket part 4', the inner diameter d of the exhaust gas pipe 1 and the overhanging length L of the jacket part 4' are coordinated with one another. The area ratio results from $$D^2/d^2$$

and is equal to about 1.5 to 5 for ship's exhaust stacks of predetermined construction. For space reasons one is often forced, in the case of ship's exhaust stacks, to select this area ratio small. Depending upon the area ratio, the axial length $L=1-5D$ must be selected.

It is understood that in the embodiments of FIGS. 1 and 2 only a single ejector is used. Of course, it is possible to arrange several jacket parts 4, respectively, 4' in sequence one behind the other, each with increasing diameter, in order to provide in this manner several ejectors in connection with one exhaust gas pipe 1.

Figure 3:
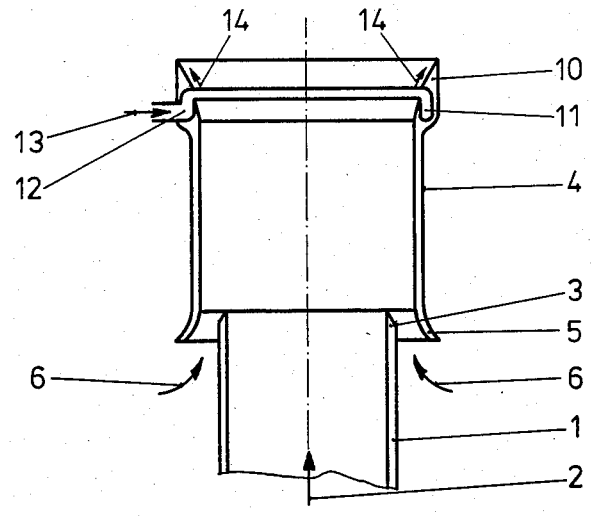
FIG. 3 shows an embodiment of the ejector with additional auxiliary air ejection.

The embodiment of FIG. 3 bases upon that of FIG. 2 and additionally shows the arrangement of a blocking-air ejection. For this purpose the jacket part 4' is provided with an annular conduit 11 which is supplied with auxiliary air from a compressed air source according to arrow 13 via a connection 12. Blowing-out of the auxiliary air is effected either over the entire circumference or with the aid of separate nozzle segments only over a part of the circumference, according to arrows 14. This produces an additional boundary layer in the region of the particularly endangered free end 10 of the jacket part 4'. Of course, this involves the disadvantage that weight and drive energy must be expended for the blower. However, it is possible to keep the auxiliary air quantity small, about on the order of 2% of the exhaust gas quantity. The auxiliary air ejection can also be additionally chosen if the outer diameter of the stack cannot be selected particularly large for other reasons.

What is claimed is:

1. Exhaust gas pipe with a free end cooled by ambient air, and for the removal of hot gases from drive means, comprising: a jacket part surrounding said exhaust gas pipe in the region of said free end and beyond said free end in outflow direction, a ring-shaped chamber between said jacket part and said exhaust gas pipe for the passage of cooling ambient air, cooling ambient air and hot exhaust gases mixing in a mixing zone, said cooling ambient air passing through said ring-shaped chamber being directed substantially along the inner wall of said jacket part and preventing hot exhaust gases and mixing zone gases from contacting the inner wall of said jacket part, said jacket part surrounding said exhaust gas pipe and being free from contact with said exhaust gas, said jacket part forming with said free end of the exhaust gas pipe an ejector for the admixing of cool ambient air, said jacket part having at all locations a greater diameter than the exhaust gas pipe, a visibility angle being formed by lines connecting mouths of said exhaust gas pipe and said jacket part, said jacket part having a diameter which is related to the length of said jacket part so that the visibility angle on the end of the exhaust gas pipe is reduced substantially from 180°, an annular conduit in said jacket part for supplying auxiliary air under pressure, said annular conduit having nozzle means for blowing said auxiliary air to the inner wall of the jacket part.

2. Exhaust gas pipe according to claim 1, wherein an inlet to said ejector is formed between the free end region of the exhaust gas pipe and said jacket part, said inlet having an increasing cross-section counter to the inlet direction of the ambient air to be admixed.

3. Exhaust gas pipe according to claim 2, wherein said jacket part has a cylindrical shape subsequent to said inlet.

4. Exhaust pipe according to claim 2, wherein said jacket part has a divergent shape in flow direction.

5. Exhaust gas pipe according to claim 1, wherein the area ratio of the jacket part to said exhaust gas pipe is at least 1.5.

6. Exhaust gas pipe according to claim 1, including an additional jacket part following said first-mentioned jacket part, said two jacket parts forming a second ejector.

7. Exhaust gas pipe with a free end cooled by ambient air, and for the removal of hot gases from drive means, comprising: a jacket part surrounding said exhaust gas pipe in the region of said free end and beyond said free end in outflow direction, a ring-shaped chamber between said jacket part and said exhaust gas pipe for the passage of cooling ambient air, cooling ambient air and hot exhaust gases mixing in a mixing zone, said cooling ambient air passing through said ring-shaped chamber being directed substantially along the inner wall of said jacket part and preventing hot exhaust gases and mixing zone gases from contacting the inner wall of said jacket part, said jacket part surrounding said exhaust gas pipe and being free from contact with said exhaust gas, said jacket part forming with said free end of the exhaust gas pipe an ejector for the admixing of cool ambient air, said jacket part having at all locations a greater diameter than the exhaust gas pipe, a visibility angle being formed by lines connecting mouths of said exhaust gas pipe and said jacket part, said jacket part having a diameter which is related to the length of said jacket part so that the visibility angle on the end of the exhaust gas pipe is reduced substantially from 180°, an annular conduit in said jacket part for supplying auxiliary air under pressure, said annular conduit having nozzle means for blowing said auxiliary air to the inner wall of the jacket part, said said nozzle means comprising subdivided individual segments.

* * * * *